US005913277A

United States Patent [19]

Resta

[11] Patent Number: 5,913,277

[45] Date of Patent: Jun. 22, 1999

[54] APPARATUS FOR CUTTING AND HEMMING CLOTHS, PARTICULARLY FOR MANUFACTURING QUILTS, DUVETS AND THE LIKE

[75] Inventor: Roberto Resta, Faenza, Italy

[73] Assignee: Resta S.r.l., Faenza, Italy

[21] Appl. No.: 09/023,104

[22] Filed: Feb. 13, 1998

[30] Foreign Application Priority Data

Feb. 24, 1997 [IT] Italy ..... BO97A0088

[51] Int. Cl.[6] ..... D05B 11/00; D05B 35/02

[52] U.S. Cl. ..... 112/470.12; 112/118; 112/141

[58] Field of Search ..... 112/470.12, 117, 112/118, 122.3, 141, 303, 305; 38/102.91; 83/175, 469, 936, 940

[56] References Cited

U.S. PATENT DOCUMENTS 4,856,439 8/1989 O'Neal et al. ..... 112/470.36 X 5,040,473 8/1991 Zesch et al. ..... 112/117

5,425,319 6/1995 Resta et al. ..... 112/118

5,544,599 8/1996 Frazer et al. ..... 112/118

5,782,193 7/1998 Schwarzberger et al. ..... 112/117 X

*Primary Examiner*—Ismael Izaguirre

*Attorney, Agent, or Firm*—Guido Modiano; Albert Josif

[57] ABSTRACT

An apparatus comprising two horizontal and parallel guides in which the lateral borders of the cloth to be quilted are inserted. The guides have grippers and can move transversely to the cloth advancement direction. Downstream of the guides there are provided two counterrotating rollers between which the cloth that exits from the guides is to be inserted. Downstream of the counterrotating rollers there is provided a cloth finishing device which forms two parallel lines of stitches. The device is also provided with a rotating blade which cuts the cloth along a line which lies between the two lines of stitches.

4 Claims, 4 Drawing Sheets

APPARATUS FOR CUTTING AND HEMMING CLOTHS, PARTICULARLY FOR MANUFACTURING QUILTS, DUVETS AND THE LIKE

BACKGROUND OF THE INVENTION

The present invention relates to an apparatus for cutting and hemming cloths, particularly for manufacturing quilts, duvets and the like.

The term "cloth" is used hereinafter to designate any product on which quilting is performed. A cloth should therefore be understood as being composed of one or more sheets of woven or non-woven fabric, superimposed so as to form a single- or multilayer cloth.

In order to manufacture quilts, duvets and the like the individual sheets that compose them are first unrolled from the respective rolls on which they are rolled up and are then mutually superimposed, so as to form a cloth which is placed on a frame, and are sewn perimetrically.

In order to provide a faster positioning and sewing step, this same Applicant has already proposed an apparatus which is disclosed in U.S. Ser. No. 08/092,638 now U.S. Pat. No. 5,425,319, to which reference is made herein for the sake of better comprehension of the present invention.

Said apparatus is characterized in that it comprises two flexible elements which are closed in a loop on vertical planes and have two horizontal and parallel upper portions on which a transverse bar is fixed which is provided with grippers for engaging the front border of said cloth.

The flexible elements are actuated so that the cloth to be quilted is moved from a position for engaging the front border to a quilting position. To the side of the horizontal portions of the flexible elements additional stationary grippers are provided, which retain the lateral borders of the cloth when said cloth has reached the quilting position.

A carriage can slide parallel to the flexible elements and is provided with grippers which alternate with those of the transverse bar in order to grip the front border in the quilting position and release it when the cloth has been transferred onto removal elements.

The transition of the engagement of the front border of the cloth from the grippers of the bar to those of the carriage is found to be rather complex in this apparatus; this complexity entails a considerable structural complication which is detrimental to the low cost of the apparatus.

Moreover, the apparatus does not allow to complete the perimetric hemming of the cloth. While the front border of the cloth is sewn upstream of the station that cuts the cloth away from the remaining rolls of fabric, the rear border, after cutting, remains open and can be sewn only during a subsequent step.

SUMMARY OF THE INVENTION

The aim of the present invention is to propose an apparatus which allows to obviate the above drawbacks, i.e., which does not require feed grippers and is adapted to complete the perimetric sewing of the cloth at each cycle.

This aim is achieved with an apparatus for cutting and hemming a cloth, particularly for manufacturing quilts, duvets and the like starting from at least one component sheet which is wound in a roll, characterized in that it comprises: a framework; means for moving said cloth in an advancement direction; two guides for supporting the lateral borders of said cloth which lie in said advancement direction along a horizontal plane of arrangement; gripper means which are arranged upstream of said guides and are actuated so as to lock said cloth transversely; a carriage, which can slide on said framework in said advancement direction; at least one sewing machine which can slide on said carriage transversely to said advancement direction; means for actuating said carriage and said sewing machine to quilt said cloth; two sewing machines, which are arranged upstream of said feeder means and are adapted to stitch the lateral borders of said cloth which exit from said guides; a cloth finishing device being arranged downstream of said feeder means and being adapted to form two parallel lines of stitches which lie transversely to the advancement direction of said cloth and a separation cut which is intermediate between said two lines of stitches, so as to separate the cloth portion located after said device from the portion located upstream of it.

BRIEF DESCRIPTION OF THE DRAWINGS

Further characteristics and advantages of the apparatus according to the present invention will become apparent from the following detailed description of a preferred embodiment thereof, illustrated only by way of non-limitative example in the accompanying drawings, wherein.

DESCRIPTION OF THE PREFERRED EMBODIMENTS

Figure 1:
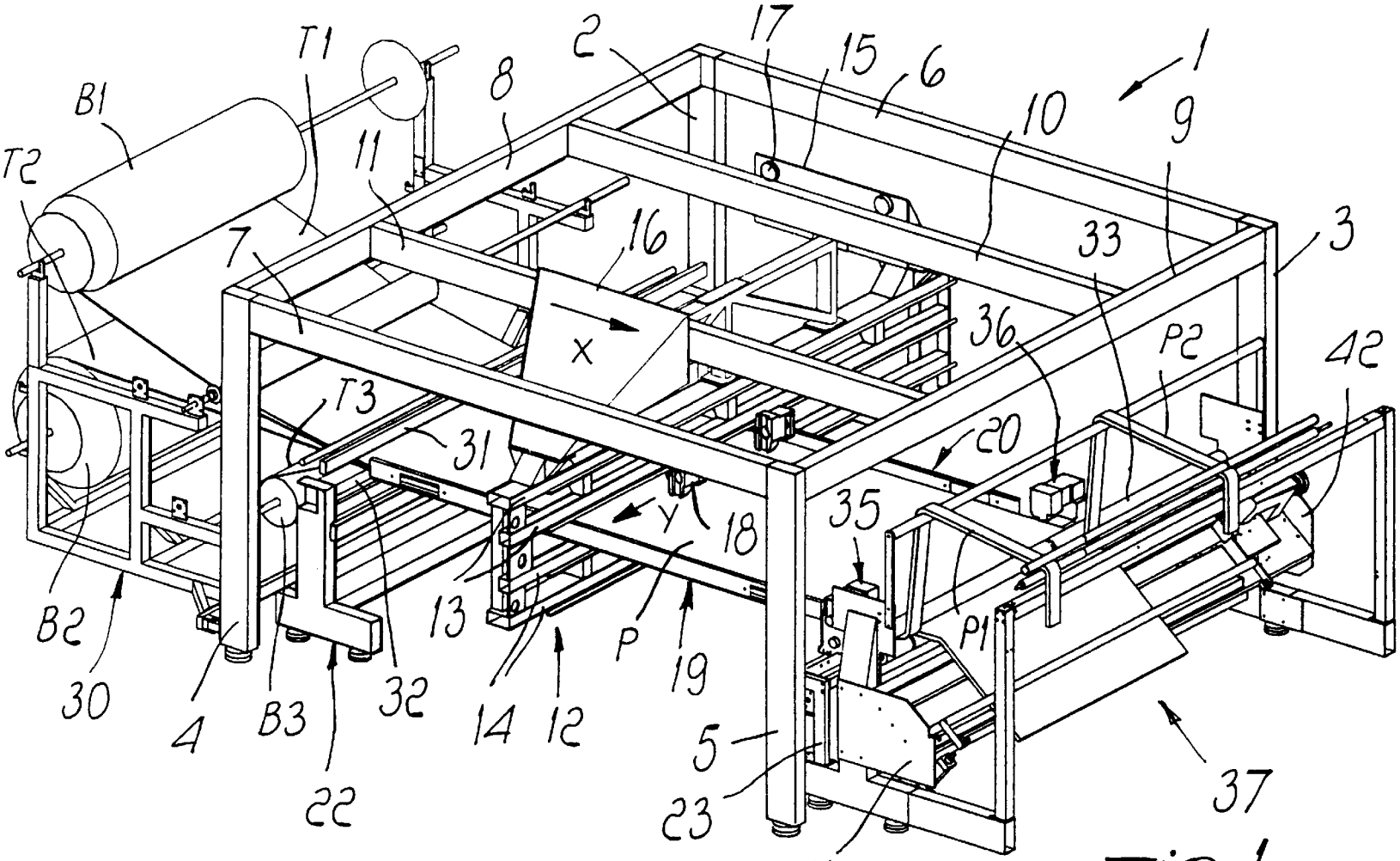
FIG. 1 is a perspective view of the apparatus according to the invention.
Figure 2:
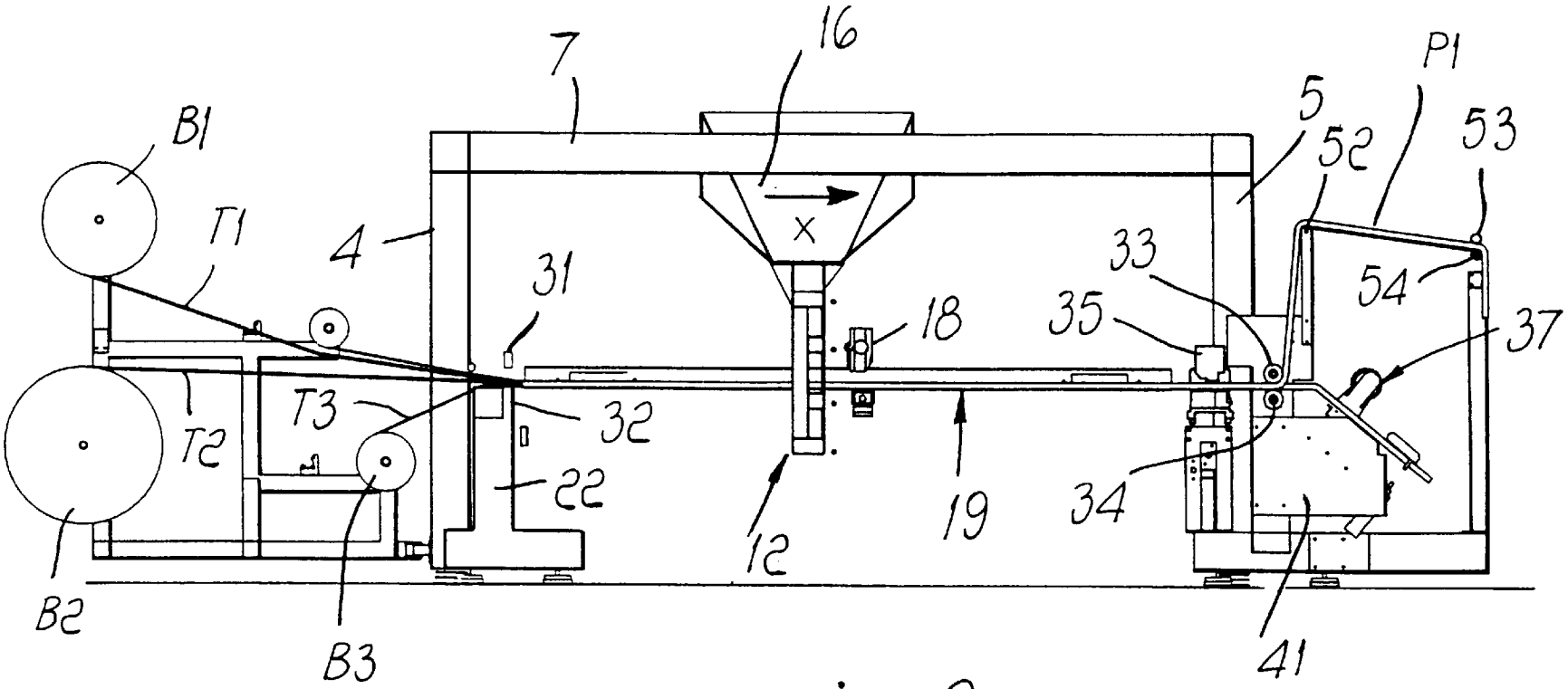
FIG. 2 is a lateral elevation view of the apparatus of FIG. 1.

With reference to FIGS. 1 and 2, the reference numeral 1 generally designates a framework which is composed of four vertical posts 2, 3, 4 and 5, which are arranged at the corners of an imaginary rectangle. The posts 2, 3 and 4, 5 are connected, at the top, by two longitudinal beams 6, 7, while two additional transverse beams 8, 9 mutually connect the tops of the posts 2, 4 and 3, 5.

Two mutually parallel longitudinal members 10, 11 lie between the transverse beams 8, 9; said longitudinal members are also parallel to the beams 6, 7 and constitute the track for the sliding of a carriage 12 for supporting one or more sewing machines.

The carriage 12 is composed of a double pair of horizontal and parallel beams 13 and 14 which lie respectively above and below the plane of arrangement of the cloth to be quilted and the opposite ends whereof are rigidly connected to each other. The carriage 12 is suspended from two shoulders 15, 16 which rest on the track 10, 11 by means of rollers 17.

The carriage 12, by means of a suitable motorization not shown in the drawings, can move along the track 10, 11 in the direction X.

The needle actuation head of the sewing machine 18 is mounted on the pair of upper beams 13 and its crochet device is mounted on the pair of lower beams 14. It is also possible to provide several sewing machines. In a conventional manner, by means of an additional motorization, the sewing machine 18 is actuated in the direction Y, at right angles to the direction X, so that by actuating the carriage 12 and the sewing machine 18 it is possible to trace the chosen path on the cloth.

Figure 3:
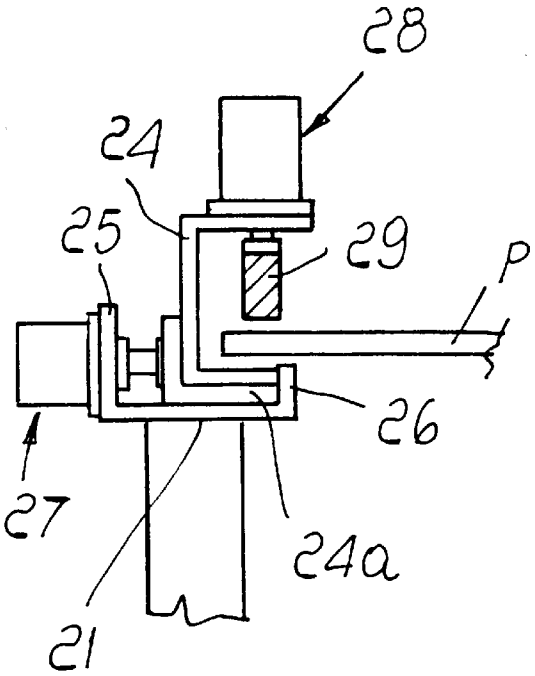
FIG. 3 is a sectional view of the guides of the lateral borders of the cloth.

Two guides 19, 20 lie between the pair of upper beams 13 and the pair of lower beams 14 and are adapted to guide the lateral borders of the cloth to be quilted. As shown by FIG. 3, each guide is composed of a longitudinal U-shaped beam 21, the opposite ends whereof are fixed on supports 22, 23 which are located at the posts 2, 4 and 3, 5 respectively. The beams 21 form resting surfaces on which profiled elements 24 are arranged which have a C-shaped cross-section and are open onto each other. The C-shaped cross-section of the guide 19 is arranged opposite to the one of the guide 20.

Each profiled element 24 can move between the outer vertical wing 25 and the inner vertical wing 26 of the beam 21 by means of pneumatic jacks 27, in which the cylinders are flanged to the outer wing of the beam 21 and the stem is rigidly coupled to the profiled element 24.

The jacks 27 related to the guide 19 are actuated in opposition to those of the guide 20, so that the profiled elements 24 of the guides are moved mutually closer and further apart simultaneously with respect to the longitudinal centerline plane of the apparatus.

The reference numeral 28 designates additional pneumatic jacks, whose cylinders are mounted vertically above the profiled elements 24. A bar 29 is fixed to the stems of the jacks 28 and protrudes inside the profiled element 24. The bar 29 constitutes the moving jaw of a gripper which is meant to engage the longitudinal border of the cloth to be quilted and clamp it against the fixed jaw, which is constituted by the lower wing 24*a* of the profiled element 24 that rests on the beam 21.

In the illustrated example, the cloth P to be quilted is formed by stacking a set of three sheets T1, T2 and T3 which, in a conventional manner not described in detail, are taken from respective rolls B1, B2 and B3 supported by a frame 30. The number of sheets and their thickness may of course be any according to requirements.

The sheets T1, T2 and T3 unrolled from the rolls B1, B2 and B3 are joined between a pair of superimposed bars 31 and 32 which lie transversely on the support 22 and are inserted in the guides 19, 20 between the bars 29 and the wings 24*a* of the profiled elements 24.

The upper bar 31 can move vertically with respect to the lower bar 32 by means of pneumatic jacks (not shown), so as to form a gripper which is suitable to transversely lock the cloth P to be quilted upstream of the guides 19, 20.

It is evident that the longitudinal grippers 24*a*, 29 and the transverse gripper 31, 32 delimit on three sides the quilting region which is delimited, on the fourth side, by a pair of feed rollers 33, 34 which are arranged at the outlet of the guides 19, 20. The rollers 33, 34, by means of respective motors, are actuated so as to rotate in opposite directions and pull in the direction X the cloth P inserted between them.

Two conventional devices 35, 36, adapted to sew the lateral borders of the quilted cloth and to cut the borders outside the sewing lines, are provided laterally between the outlet of the guides 19, 20 and the feed rollers 33, 34.

Downstream of the feed rollers 33, 34 there is provided a finishing device, generally designated by the reference numeral 37, adapted to cut the cloth P transversely and to sew the borders upstream and downstream of the performed cut.

Figure 4:
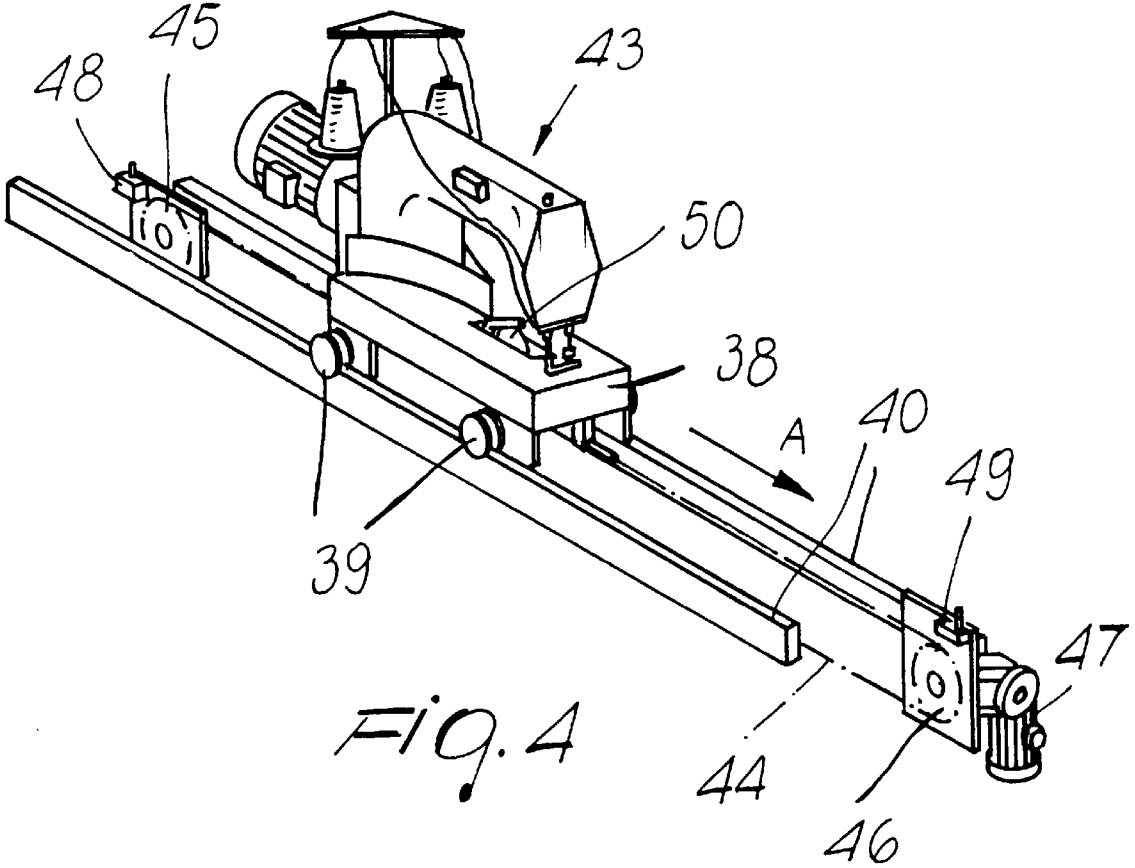
FIG. 4 is a perspective view of the device for finishing the quilted cloth.
Figure 6:
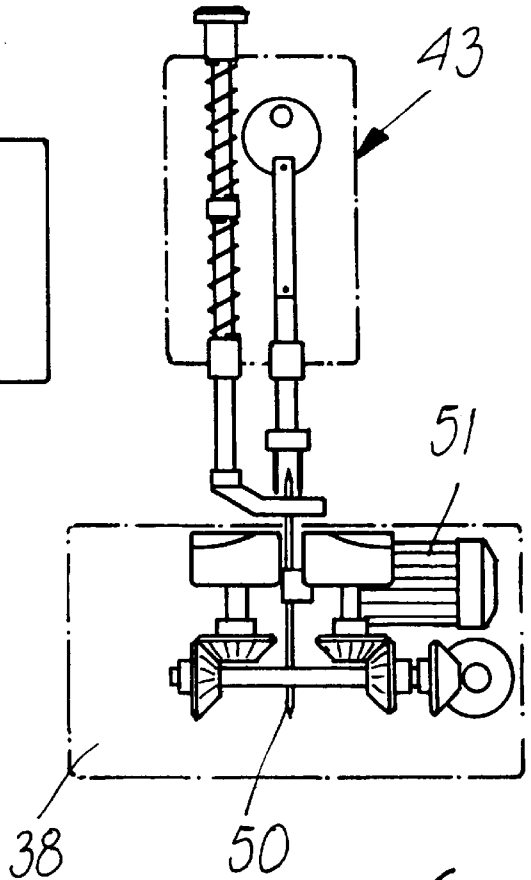
FIG. 6 is a front elevation view of said device.
Figure 5:
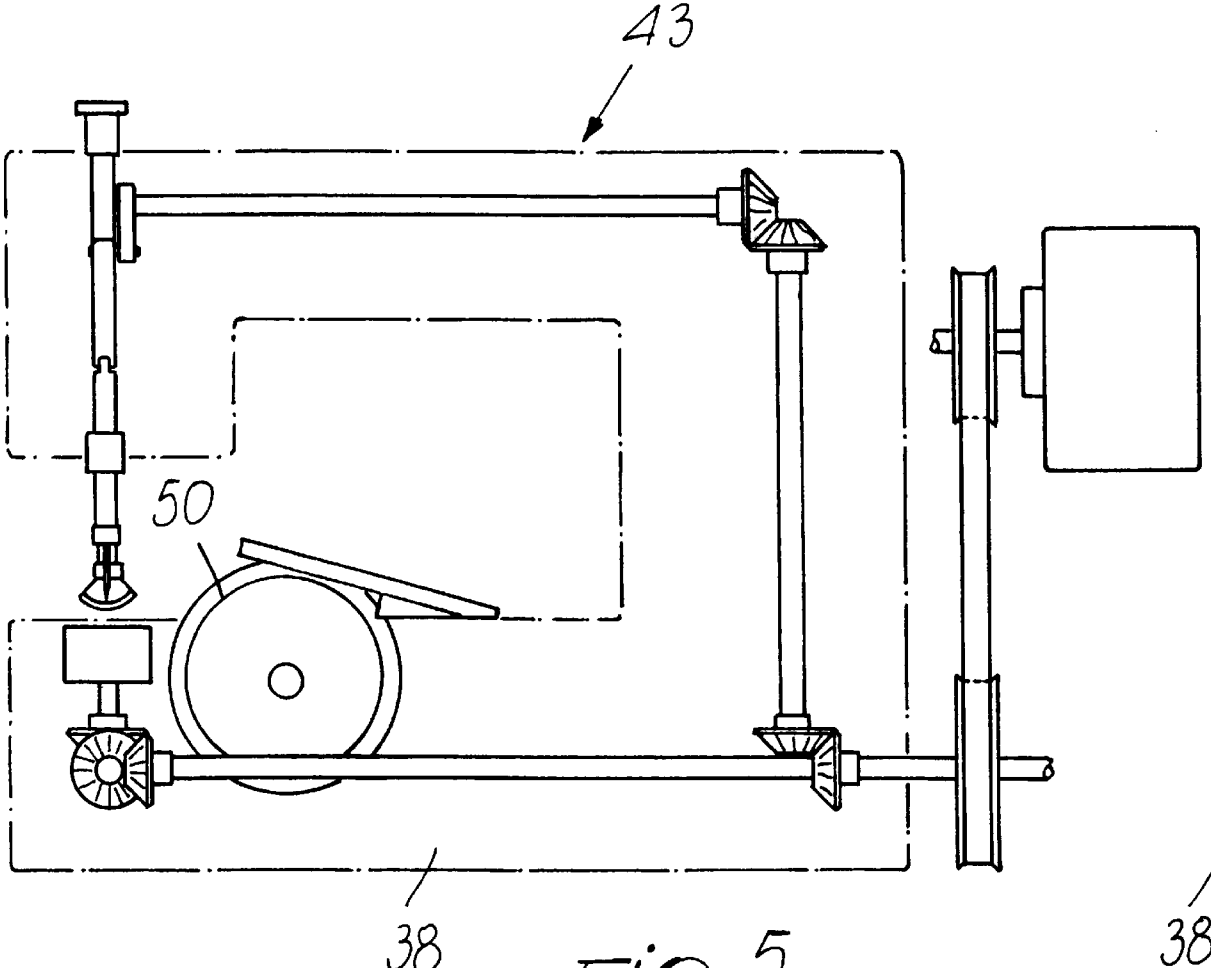
FIG. 5 is a partially schematic lateral elevation view of the device of FIG. 4; and finally

As shown by FIGS. 4, 5 and 6, said device comprises a box-like carriage 38 which, by means of four freely rotating wheels 39, slides on two rails 40 which are parallel and whose opposite ends are fixed to sides 41, 42 which rest on the ground.

A sewing head of a sewing machine 43 of the two-needle type, for example of the kind disclosed in Italian patent no. 1,183,122 in the name of this same Applicant, is mounted on the carriage 38.

The sewing machine 43 is moved transversely to the direction X by means of a movement system which comprises a chain 44 which is fixed to the carriage 38 and is closed in a loop around two toothed sprockets 45, 46 which are mounted in a cantilevered manner on the sides 41, 42. The sprocket 45 rotates freely, while the other sprocket 46 is driven by a gearmotor 47 flanged onto the side 41. The gearmotor 47 is controlled by two limit switches 48, 49, which set the reversing points of the forward and return strokes. The double line of stitches is formed during a single forward stroke, while the cloth is being cut in the region between the two lines of stitches.

A rotating circular blade 50, rotatably supported in the carriage 38, is provided to perform the separation cut.

The rotating blade 50 can be actuated by the same motor that drives the sewing head, by means of a transmission as disclosed in Italian patent no. 1,183,122. However, the blade 50 is preferably actuated by an electric motor 51 of its own, which is accommodated in the carriage 38.

The rotating blade 50 protrudes, with an upper sector, from the upper face of the carriage 38 through a slot formed therein.

Operation of the described apparatus is as follows. Assuming that the apparatus is in an operating condition as shown in FIGS. 1 and 2, wherein the cloth P is locked upstream between the bar 31 and the beam 32 and downstream between the rollers 33, 34, while the lateral borders of the cloth are locked in the guides 19, 20 by the bars 29.

In practice, the lateral guides 19, 20, the bar 32 and the rollers 33, 34 form a frame which keeps the cloth P stretched both transversely and longitudinally.

With the cloth in this condition, quilting is performed by moving the carriage 12 in the direction X and the sewing heads 18 in the direction Y.

As quilting continues, the double line of stitches is formed and the cloth is cut downstream of the rollers 33, 34. In this manner, the upstream line of stitches closes the front border of the cloth being quilted, while the downstream line of stitches closes the rear border of the previously quilted cloth.

When quilting has ended, the two longitudinal bars 29 and the transverse bar 31 are raised; by releasing the lateral borders and the upstream border of the cloth, they allow the rollers 33, 34 to unroll new portions of sheets T1, T2, T3 from the rolls B1, B2, B3 and to form a new cloth P.

It should be noted that during unrolling the two devices 35, 36 sew the lateral borders of the cloth that exit from the guides 19, 20 and cut the flaps P1, P2. In order to remove the flaps P1, P2 there are provided a deflector roller 52 and two counterrotating rollers 53, 54 between which the flaps are guided. The actuation of the rollers 53, 54 can be drawn from the actuation of the feed rollers 33, 34. When the rear border of the quilted cloth, which was beneath the bar 31, arrives at the sewing line of the sewing machine 43, the rollers 33, 34 are stopped and the jacks that lower the bars 29 and 31 are actuated sequentially, locking the lateral and rear borders. Then, by actuating the jacks 27, the lateral borders of the cloth are spaced, so as to stretch the cloth transversely, while longitudinal traction is produced by continuing the rotation of the rollers 33, 34 after the bar 31 has locked the cloth P transversely against the beam 32.

At this point, quilting is performed and the production steps are repeated as described above.

It is evident that the described invention perfectly achieves the intended aim. In particular, it is noted that the device 37 arranged downstream of the actuation rollers 33, 34 allows to complete the peripheral hemming of the cloth after quilting and therefore to eliminate subsequent finishing operations.

What is claimed is:

1. An apparatus for cutting and hemming a cloth, obtained starting from at least one component sheet which is wound in a roll, comprising: a framework; feeder means for moving said cloth in an advancement direction; two guides for supporting lateral borders of said cloth which lie in said advancement direction along a horizontal plane of arrangement; gripper means which are arranged upstream of said guides and are actuated so as to lock said cloth transversely; a carriage, which is slideable on said framework in said advancement direction; at least one sewing machine being slideable on said carriage in a direction which is transverse to said advancement direction; actuation means for actuating said carriage and said sewing machine to quilt said cloth; two sewing machines being arranged upstream of said feeder means for stitching the lateral borders of said cloth exiting from said guides; a finishing device for finishing the cloth which is arranged downstream of said feeder means to form two parallel lines of stitches lying transversely to said advancement direction of said cloth, and a separation cut, said separation cut being intermediate between said two lines of stitches, so as to separate a cloth portion located downstream of said finishing device from a portion located upstream of the device.

2. The apparatus of claim 1, comprising: on each one of said guides a longitudinal beam which forms a resting plane; a profiled element which is open towards a longitudinal centerline plane of the apparatus being provided on said resting plane; fluid-actuated jacks for moving said profiled element transversely to the advancement direction of the cloth; a bar which is accommodated in said profiled element; further jacks for actuating said bar vertically, said bar and said profiled element constituting gripper means for gripping longitudinal borders of said cloth.

3. The apparatus of claim 2, wherein said sewing machines for sewing the lateral borders of said cloth along sewing lines exiting from said guides are provided with cutting means for cutting lateral flaps of the cloth that lie outside the sewing lines.

4. The apparatus of claim 3, comprising: a box-like carriage provided at said finishing device; two rails which lie transversely to the cloth advancement direction, said carriage being slideable on said rails; a sewing machine of the two-needle type which is mounted on said carriage; driving means for actuating said carriage on said rails between two stroke limit positions; a rotating circular blade which is supported for being rotatable in said carriage, said blade being arranged on a plane which passes between said two needles, and having an upper sector which protrudes from a sewing plane formed by said sewing lines.

* * * * *